US006408713B1

(12) United States Patent
Mitsch

(10) Patent No.: US 6,408,713 B1
(45) Date of Patent: Jun. 25, 2002

(54) LOCOMOTIVE BRAKE VALVE HANDLE WITH WEAR PAD

(75) Inventor: Matthew D. Mitsch, Pittsburgh, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/586,046

(22) Filed: Jun. 2, 2000

(51) Int. Cl.[7] ..... G05G 1/00
(52) U.S. Cl. ..... 74/545
(58) Field of Search ..... 74/543, 545, 523, 74/551.9, 548; 16/435, 431, 902

(56) References Cited

U.S. PATENT DOCUMENTS 105,919 A * 8/1870 Davids ..... 74/543 X
2,125,783 A * 8/1938 Heeman ..... 16/902 X
3,484,808 A * 12/1969 Conterno ..... 74/543
5,640,741 A * 6/1997 Yano ..... 16/902 X
6,105,460 A * 8/2000 Li ..... 74/551.9
6,122,802 A * 9/2000 Lo ..... 16/431
6,230,366 B1 * 5/2001 Lin ..... 16/431

* cited by examiner

*Primary Examiner*—David A. Bucci
*Assistant Examiner*—Timothy McAnulty
(74) *Attorney, Agent, or Firm*—James Ray & Associates

(57) ABSTRACT

The present invention provides a brake valve handle assembly for use in a brake valve of a railway braking system. The handle assembly comprises a handle for manually adjusting such brake valve to various positions and having a cavity with a predetermined shape and a predetermined width formed in the handle at least adjacent a top surface thereof that is disposed adjacent a slot formed in a housing of such brake valve. The handle assembly further includes a wear pad mounted in the cavity of the handle and a means for securing the wear pad to the handle.

20 Claims, 3 Drawing Sheets

LOCOMOTIVE BRAKE VALVE HANDLE WITH WEAR PAD

FIELD OF INVENTION

The present invention relates, in general, to a handle for an independent brake valve, and more particularly, the present invention relates to a brake handle which has incorporated a wear pad into the handle in the area of the handle that comes in contact with such brake valve.

BACKGROUND OF THE INVENTION

Independent manually operated brake valves have been used in the railroad industry for many years and provide a means for independent control of the locomotive brake cylinder pressure irrespective of the automatic brake. The independent brake valve has two positions. There is a Release position at one end of the quadrant and a Full Application position at the other end of the quadrant. From Release to Full Application position is an application zone or sector and the further the handle is moved to the right into the sector, the greater will be the application pressure available until full application pressure is obtained at the extreme right of the handle movement. Movement of the independent brake valve handle from Release position towards Full Application position actuates a cam which in turn positions a supply and exhaust valve assembly to first seat the exhaust, valve and then unseat the supply valve. Main reservoir air will then flow past the unseated supply valve from one port to another port.

The movement of the handle of the independent brake valve allows the locomotive operator to manually adjust the brake valve to various positions resulting in varying amounts of brake application. However, the handle comes into physical contact with the brake valve assembly as it is moved through the application zone causing the hardened metal of the handle to wear where it interfaces with the valve. When the handle becomes worn, it is scrapped and replaced with a new handle.

SUMMARY OF THE INVENTION

The present invention provides a brake valve handle assembly for use in a brake valve of a railway braking system. The handle assembly comprises a handle for manually adjusting such brake valve to various positions and a cavity having a predetermined shape and a predetermined width formed in the handle at least adjacent a top surface thereof that is disposed adjacent a slot formed in a housing of such brake valve. The handle assembly further includes a wear pad mounted in the cavity of the handle and a means for securing the wear pad to the handle.

OBJECTS OF THE INVENTION

It is, therefore, one of the primary objects of the present invention to provide a brake handle with a wear pad which can be replaced when it is worn rather than replace the entire handle.

It is also an object of the present invention to provide an a wear pad for a brake handle that is easily replaced.

An additional object of the present invention is to provide a wear pad for a handle that can be used with existing handles that have worn.

These and various other objects and advantages of this invention will become apparent after a full reading of the following detailed description, particularly, when read in conjunction with the attached drawings as described below and the appended claims.

Figure 1:
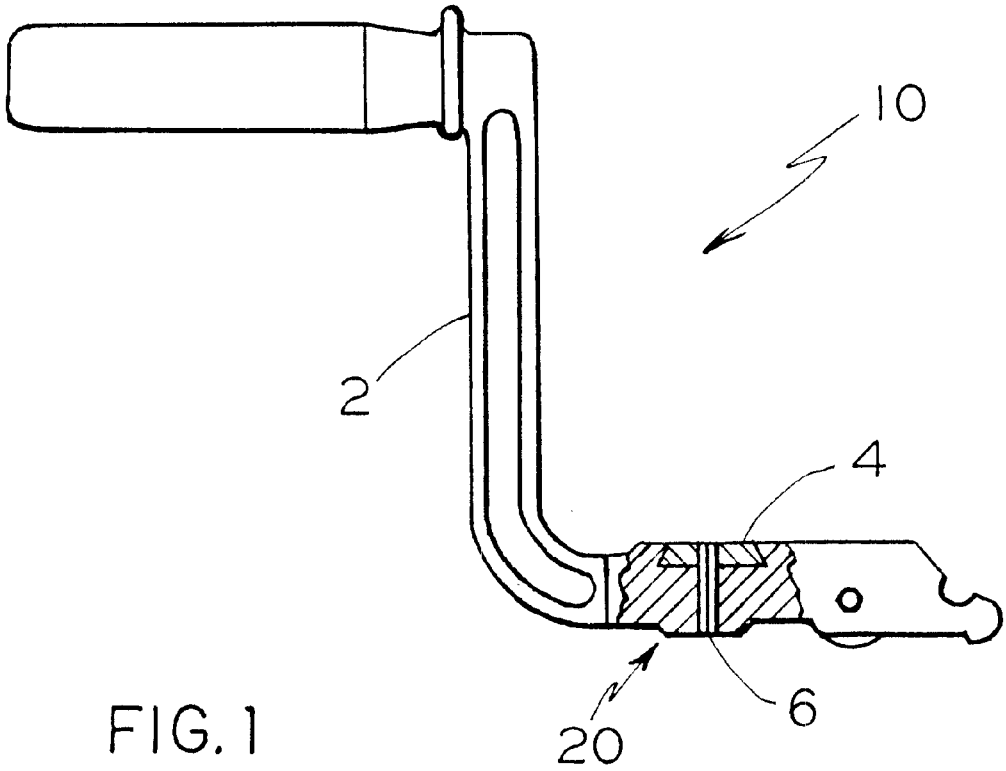
FIG. 1 is an partial cross sectional view of a brake handle incorporating an embodiment of the present invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
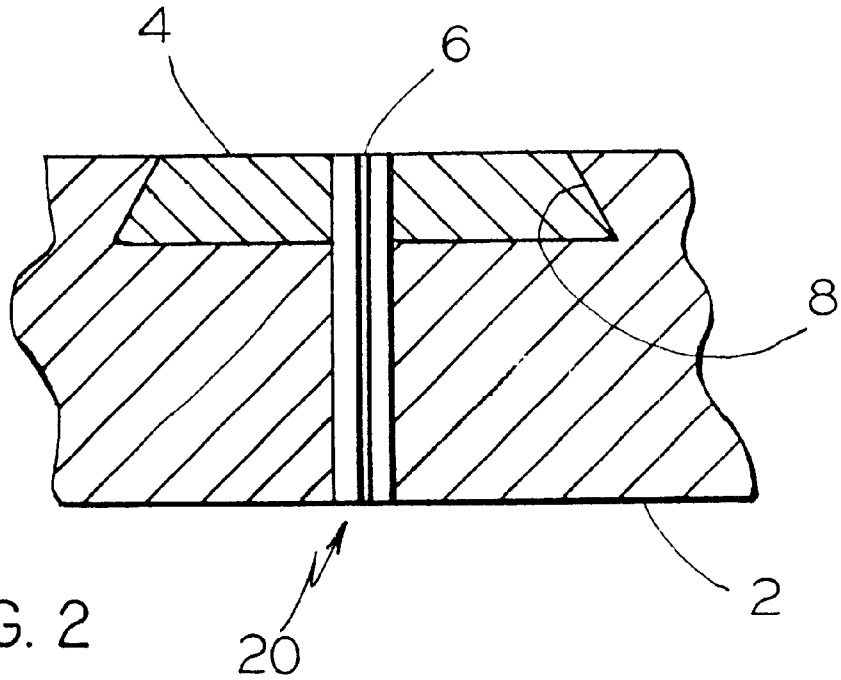
FIG. 2 is an enlarged cross sectional view of a portion of a brake handle showing the wear pad.
Figure 3:
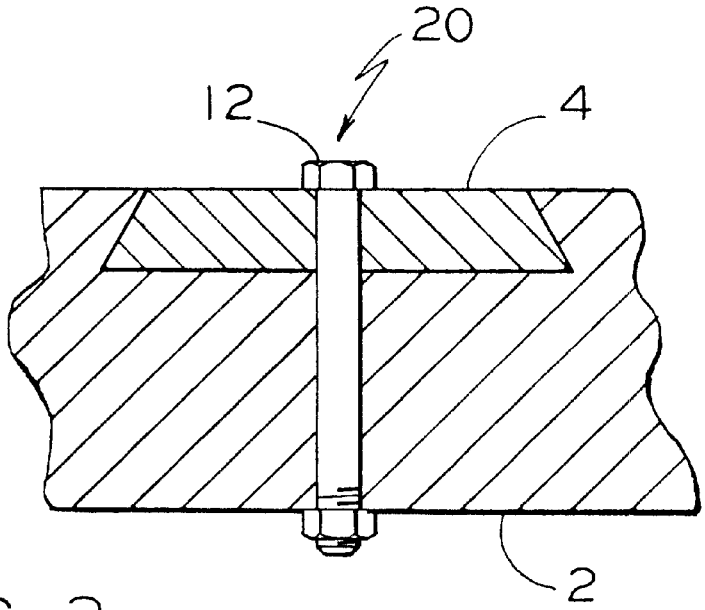
FIG. 3 is an enlarged cross sectional view of a portion of a brake handle showing the wear pad with a bolt as a securing means.
Figure 4:
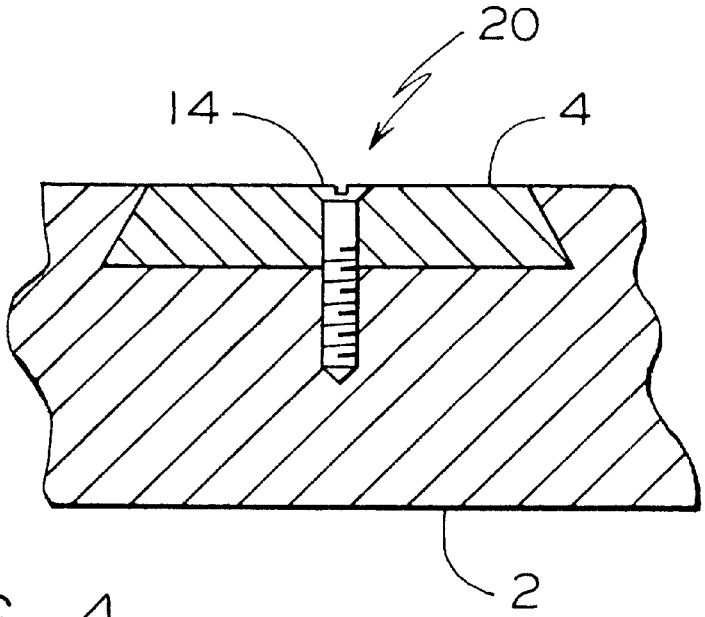
FIG. 4 is an enlarged cross sectional view of a portion of a brake handle showing the wear pad with a screw as a securing means.
Figure 5:
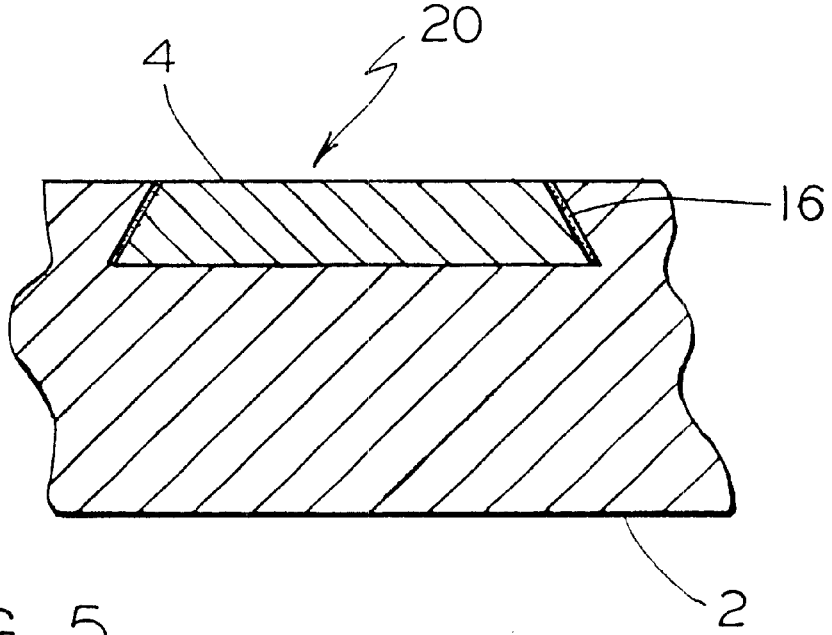
FIG. 5 is an enlarged cross sectional view of a portion of a brake handle showing the wear pad with an adhesive as a securing means.
Figure 6:
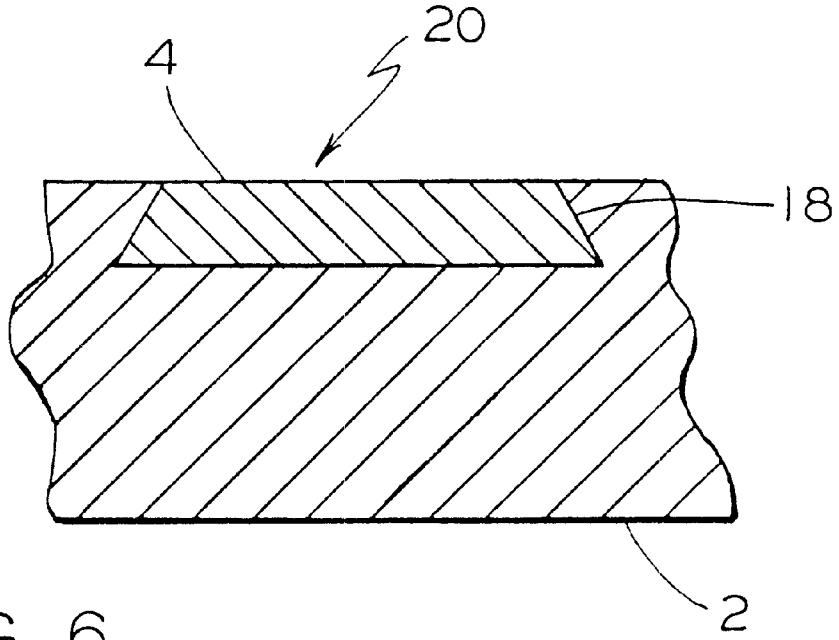
FIG. 6 is an enlarged cross sectional view of a portion of a brake handle showing the wear pad with the securing means being a friction fit.

Illustrated in FIGS. 1 and 2 is a locomotive brake valve handle assembly, generally designated 10, incorporating an embodiment of the present invention. The present invention provides such brake valve handle assembly 10 for use in a locomotive brake valve (not shown) of a railway braking system.

The handle assembly 10 includes a handle 2 for manually adjusting such brake valve to various positions. There is a cavity 8 formed in such handle 2 having a predetermined shape and a predetermined width. Such cavity 8 is at least adjacent a top surface of the handle 2 that is disposed adjacent a slot in a housing of such brake valve. Such cavity 8 extends across the diameter of the handle 2 and such predetermined width of the cavity is sufficient to encompass the area of the handle 2 that comes into physical contact with such slot of such brake valve assembly when the handle 2 is pivoted and moved through various positions in the application zone. In a presently preferred embodiment of the invention such predetermined shape of such cavity 8 is in the form of a trapezoid.

The handle assembly in FIG. 1 shows an offset type handle; however, the present invention is applicable to handles having various configurations. Many handles in brake valves are straight as opposed to being offset and the invention is the same regardless of the shape of the handle since the invention only involves only the portion of the handle that is in physical contact with the slot of such brake valve assembly.

The handle assembly 10 further includes a wear pad 4 which is mounted in the cavity 8 of the handle 2. Such handle 2 is generally made of hardened steel. In a first embodiment of the invention such wear pad 4 is made of a heat treatable metallic material. It is presently preferred that such heat treatable metallic material be a hot rolled alloy steel. Such wear pad has a predetermined shape which corresponds to the shape of the cavity 8 in handle 2. In the preferred embodiment of the invention such shape of such wear pad 4 is the shape of a trapezoid as is the shape of cavity 8. Such trapezoidal shape of the cavity 8 and such wear pad 4 permits the wear pad 4 to be easily slid into the cavity 8 and further such shape prevents the wear pad 4 from falling out of the handle 2 in a vertical direction as the handle 2 is moved throughout the application zone.

The present invention further includes a means, generally designated 20, for securing such wear pad 4 to such handle 2. Such means 20 is used to prevent any horizontal or lateral movement of the wear pad 4 in such cavity 8 of handle 2. Such means 20 further may include an aperture formed in such wear pad 4 and a correspondingly aligned aperture in such handle 2.

Such means 20 may include a spring pin 6, a bolt 12, a clip, a screw 14, friction fit 18, adhesive 16 or any combination thereof for securing the wear pad 4 to the handle 2. In a presently preferred embodiment of the invention such securing means 20 provides for a spring pin 6. It is also presently preferred that such spring pin 6 be a cylindrical pin that extends through the apertures in the wear pad 4 and the handle 2.

Such wear pad 4 comes into physical contact with such brake valve assembly when the handle is moved through the positions in the application zone. Thus, all of the wear associated with the interfacing with the brake valve assembly is borne by the wear pad 4. The wear pad 4 is sacrificed to the point where it will require replacement. As mentioned previously, in an embodiment of the invention such wear pad 4 is secured by such spring pin 6. Such spring pin 6 is like a dowel that fits through the apertures in the wear pad 4 and the handle 2. The securing means 6, such as the spring pin, prevents or at least restricts any horizontal movement of the wear pad 4. The trapezoidal shape of such cavity 8 and such wear pad 4 prevents or restricts any vertical movement of the wear pad 4. When the wear pad 4 is worn out the spring pin 6 is knocked out of such handle 2 and wear pad 4 and the wear pad 4 is simply slid out of the cavity 8 and a new wear pad 4 is inserted and secured with a spring pin 6.

Thus, the present invention provides a cost reduction. Previously, when the handle 2 became worn it was simply discarded and replaced with a new handle 2. It is much more cost effective to simply replace a small inexpensive wear pad 4 than to replace the entire handle 2 since the rest of the handle is not adversely affected by wear. The present invention can be used for new production handle assemblies, so that the wear pad 4 can simply be replaced when required. It can also be applied to handles presently in service, with the existing design, that have become worn by simply modifying such handles with a cavity and wear pad. This will enable handles to be reused instead of being scrapped as is the present custom.

Another possible cost saving could be that since the wear pad is being sacrificed, that it might be possible to make the handle out of a material that is less costly than the hardened steel that is presently used.

The above description detailed the invention as applied to the handle of a brake valve assembly in a locomotive braking system. However, the invention is also applicable to other embodiments involving handles in a variety of applications. The invention is applicable to any handle usage wherein such handle is in contact with at least one edge of a slot when the handle is moved from one position to another which would tend to cause wear on the handle.

While both the presently preferred and a number of alternative embodiments of the present invention have been described in detail above it should be understood that various other adaptations and modifications of the present invention can be envisioned by those persons who are skilled in the relevant art of railway braking systems without departing from either the spirit of the invention or the scope of the appended claims.

What is claimed is:

1. A handle assembly for use in a locomotive brake valve of a railway braking system, said handle assembly comprising:

(a) a handle member, having a predetermined configuration, for manually adjusting such brake valve to various positions;

(b) a cavity having a predetermined shape and a predetermined width formed in said handle member at least adjacent a top surface thereof and adjacent an elongated slot formed in a housing of such brake valve;

(c) a wear pad mounted in said cavity of said handle member for frictional engagement with such slot; and (d) a means for securing said wear pad to said handle member.

2. A handle assembly for use in a brake valve of a railway braking system, according to claim 1, wherein said means for securing said wear pad to said handle member is at least one of an adhesive and a friction fit.

3. A handle assembly for use in a brake valve of a railway braking system, according to claim 2, wherein said means for securing said wear pad to said handle member is a friction fit.

4. A handle assembly for use in a brake valve of a railway braking system, according to claim 2, wherein said means for securing said wear pad to said handle member is an adhesive.

5. A handle assembly for use in a brake valve of a railway braking system, according to claim 1, wherein said means for securing said wear pad to said handle member further includes an aperture disposed in said wear pad.

6. A handle assembly for use in a brake valve of a railway braking system, according to claim 5, wherein said means for securing said wear pad to said handle member further includes an aperture disposed in said handle member and aligned with said aperture disposed in said wear pad.

7. A handle assembly for use in a brake valve of a railway braking system, according to claim 6, wherein said means for securing said wear pad to said handle member is one of a spring pin, screw and bolt disposed in said aperture formed in said wear pad and said aperture formed in said handle member.

8. A handle assembly for use in a brake valve of a railway braking system, according to claim 7, wherein said means for securing said wear pad to said handle member is a spring pin.

9. A handle assembly for use in a brake valve of a railway braking system, according to claim 8, wherein said spring pin is a cylindrical pin.

10. A handle assembly for use in a brake valve of a railway braking system, according to claim 7, wherein said means for securing said wear pad to said handle member is a bolt.

11. A handle assembly for use in a brake valve of a railway braking system, according to claim 7, wherein said means for securing said wear pad to said handle member further includes one of an adhesive and a friction fit.

12. A handle assembly for use in a brake valve of a railway braking system, according to claim 1, wherein said wear pad is a heat treatable metallic material.

13. A handle assembly for use in a brake valve of a railway braking system, according to claim 12, wherein said heat treatable metallic material is a hot rolled alloy steel.

14. A handle assembly for use in a brake valve of a railway braking system, according to claim 12, wherein said handle member is made of a less costly material than said heat treatable metallic material.

15. A handle assembly for use in a brake valve of a railway braking system, according to claim 1, wherein said predetermined shape of said cavity is a trapezoid.

16. A handle assembly for use in a brake valve of a railway braking system, according to claim 15, wherein said wear pad has a corresponding trapezoidal shape.

17. A handle assembly for use in a brake valve of a railway braking system, according to claim 1, wherein said predetermined width of said cavity and a width of said wear pad is sufficient to encompass an area of said handle member that is in physical contact with such slot as said handle member is pivoted and moved through various positions.

18. A handle assembly disposed for sliding frictional engagement during service with at least one edge of a slot, said handle assembly comprising:

(a) a handle member, having a predetermined configuration;

(b) a cavity having a predetermined shape and a predetermined width formed in said handle member at least adjacent a surface thereof that is disposed for sliding frictional engagement during service with such slot;

(c) a wear pad mounted in said cavity of said handle member for sliding frictional engagement with such slot; and (d) a means for securing said wear pad to said handle member.

19. A handle assembly, according to claim 18, wherein said means for securing said wear pad to said handle member is at least one of an adhesive and a friction fit.

20. A handle assembly, according to claim 18, wherein said predetermined width of said cavity and a width of said wear pad is sufficient to encompass an area of said handle member that is in physical contact with such slot as said handle member is moved through various positions.

* * * * *